United States Patent [19]

Roetter et al.

[11] 4,261,497

[45] Apr. 14, 1981

[54] BURSTING APPARATUS

[75] Inventors: Francis T. Roetter, Westport; Frank A. Oeschger, East Norwalk, both of Conn.

[73] Assignee: Pitney Bowes Inc., Stamford, Conn.

[21] Appl. No.: 4,424

[22] Filed: Jan. 18, 1979

[51] Int. Cl.[3] ..... B26F 3/02

[52] U.S. Cl. ..... 225/100; 225/106

[58] Field of Search ..... 225/2, 4, 100, 101, 225/106, 98

[56] References Cited

U.S. PATENT DOCUMENTS

| | | | |
|---|---|---|---|
| 2,375,542 | 5/1945 | Euth | 225/100 |
| 2,649,156 | 8/1953 | Stafford | 225/100 |
| 3,331,543 | 7/1967 | Kezeli | 225/100 X |
| 3,484,031 | 12/1969 | Pine | 225/100 |
| 3,672,551 | 6/1972 | Peterson | 225/100 |
| 3,770,172 | 11/1973 | Nystrand et al. | 225/106 X |
| 3,792,807 | 2/1974 | Mare et al. | 225/106 X |
| 3,888,399 | 6/1975 | Hanson et al. | 225/100 X |
| 4,091,978 | 5/1978 | Graham | 225/100 |

*Primary Examiner*—Frank T. Yost

*Attorney, Agent, or Firm*—Mark Levy; William D. Soltow, Jr.; Albert W. Scribner

[57] ABSTRACT

A bursting apparatus for separating one or two continuous webs of material along transverse lines of weakening thereon. The material is fed through two pairs of rollers driven by suitable driving apparatus. Magnetic clutch and magnetic brake assemblies halt rotation of one pair of rollers upstream the transverse line of weakening, while the other pair of rollers continues to grip and feed the material. The resultant longitudinal tension along the material promotes rupture at the transverse line of weakening. A breaker roller mounted between the two pairs of rollers has axially mounted spheres to promote discrete points of increased tension along the transverse line of weakening. The bursting operation is repetitive and continuous. Separated sheets are successively transported or stacked after passing through the rollers.

24 Claims, 6 Drawing Figures

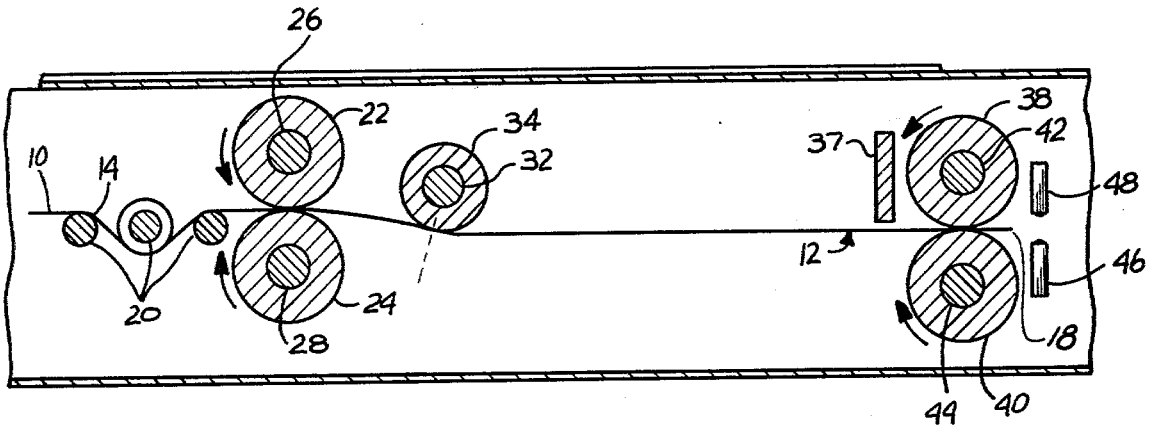
Fig. 2
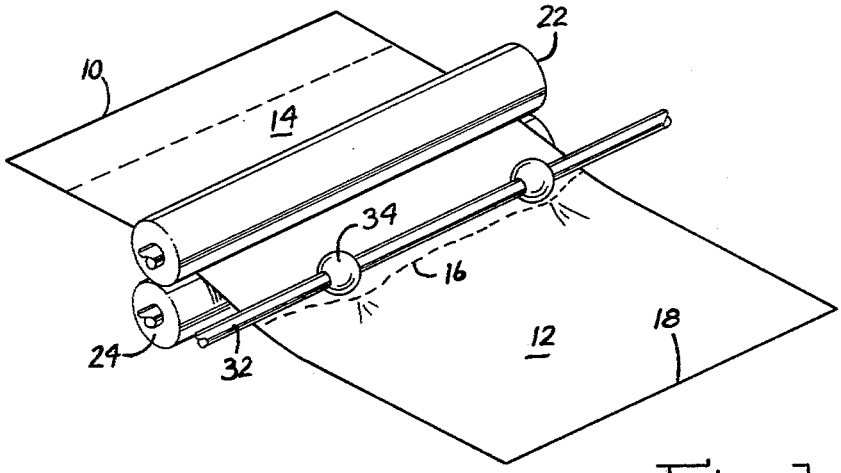
Fig. 3
Fig. 6
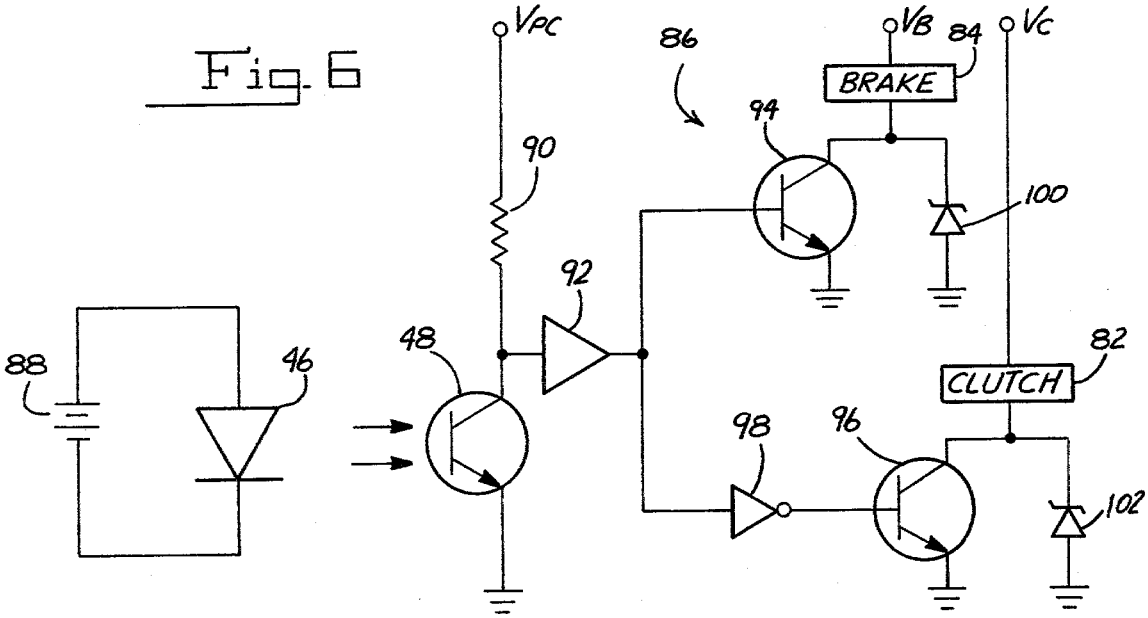

BURSTING APPARATUS

BACKGROUND OF THE INVENTION

This invention relates to bursting apparatus and more particularly to the separation (tearing) of a continuous web of material along transverse lines of weakening.

Forms of stationery are often preprinted on a continuous web of perforated material. Such forms are conventionally used in billing and other typical business transactions. The continuous series of forms requires processing for end use such as mailing. This may require bursting or separating the forms, as well as the performance of the end functions of stacking, stamping, sealing, inserting, collating (for additional enclosures) and folding. The aforesaid end functions are all provided for with existing equipment in one continuous process. There is, however, need for an inexpensive apparatus that performs a separating function and that can be integrated with existing paper handling equipment. The present invention fulfills this need by using a novel principle of operation as hereinafter described in detail.

U.S. Pat. No. 704,472 teaches the use of two pairs of rollers driven at different relative speeds to effect sufficient tension on perforated paper directed between them to cause separation. Apparatus of that general class often require two distinct means for driving pairs of rollers at different rates of speed, complex gear or pulley systems for effectuating different roller surface velocities derived from the same drive means, or rollers with different radii each of which systems entails its own special set of problems, not the least of which is cost due to complexity.

U.S. Pat. No. 773,816 teaches the use of a braking mechanism in a ticket dispensing system to halt infeed rollers without affecting the outfeed rollers. The braking mechanism in that system consists of a cam mounted on a shaft which forces a flap against a spring-assisted lever at predetermined intervals. Besides the eventual inoperativeness of that system due to component misadjustment and fatigue, that system suffers from the following drawback: tickets of only one length may be separated, said length being a function of the shape and circumference of the cam.

The use of a solenoid clutch in combination with a clamping bar is taught in U.S. Pat. No. 3,888,399, assigned to the present assignee. A segmented burster roller is rotated once per cycle, each time a continuous series of forms is advanced to a predetermined bursting position. Drive to the infeed rollers is disengaged after each cycle to allow the burster roller to separate a form from the continuous series of forms. A timing cam ensures disengagement of the infeed rollers and rotation of the burster roller at the proper time, as predetermined by the form length in that system. A method of bursting without recourse to intermittent advancement techniques, however, is thought to represent an improvement in the burster art by using less moving parts and thus extending the life of the mechanism.

SUMMARY OF THE INVENTION

The present invention is a bursting apparatus and method for conveying one or two webs of material along a longitudinal path of travel and for separating the webs along lines of perforations substantially perpendicular to the direction of travel. The apparatus comprises two pairs of feed rollers perpendicular to the path of travel through which the web is fed. A breaker roller is located in the path of travel between the two pairs of feed rollers for increasing tension along the line of web perforations and causing the webs to rupture along that line. A magnetic brake and a magnetic clutch are connected to opposite sides of the first feed roller. The clutch and brake work together to slow and halt the first pair of feed rollers at predetermined times, as controlled by an electronic timing circuit. Since the second pair of feed rollers is driven at a constant and continuous rate of speed, severance of the webs is promoted along the line of perforations.

From the above compendium, it will be appreciated that it is an object of this invention to provide a novel bursting apparatus to separate one or two webs of material continuously and repetitively.

A further object of this invention is to provde a bursting apparatus that includes only one source of drive operated at a constant rate of speed.

Another object of this invention is to provide a bursting apparatus that can be adjusted to separate forms of different lengths.

A still further object of this invention is to provide a bursting apparatus that incorporates the principle of intermittently halting one pair of rollers while maintaining drive of constant velocity at the other pair of rollers.

Other objects of the invention in part will be obvious and in part will be pointed out hereinafter.

With these ends in view, the invention finds embodiment in certain combinations of elements and arrangements of parts and series of steps by which the said objects and certain other objects are hereinafter attained, all as fully described with reference to the accompanying drawings and the scope of which is more particularly pointed out and indicated in the appended claims.

BRIEF DESCRIPTION OF THE DRAWINGS

FIG. 2 is a conceptual side view insection of the bursting apparatus for performing the bursting function in accordance with this invention.

FIG. 3 is an enlarged conceptual isometric view of the breaker roller operating on a continuous web of forms.

FIG. 6 is an electronic schematic diagram for electronically performing the functions of the bursting apparatus in accordance with this invention.

DESCRIPTION OF THE PREFERRED EMBODIMENT

Figure 1:
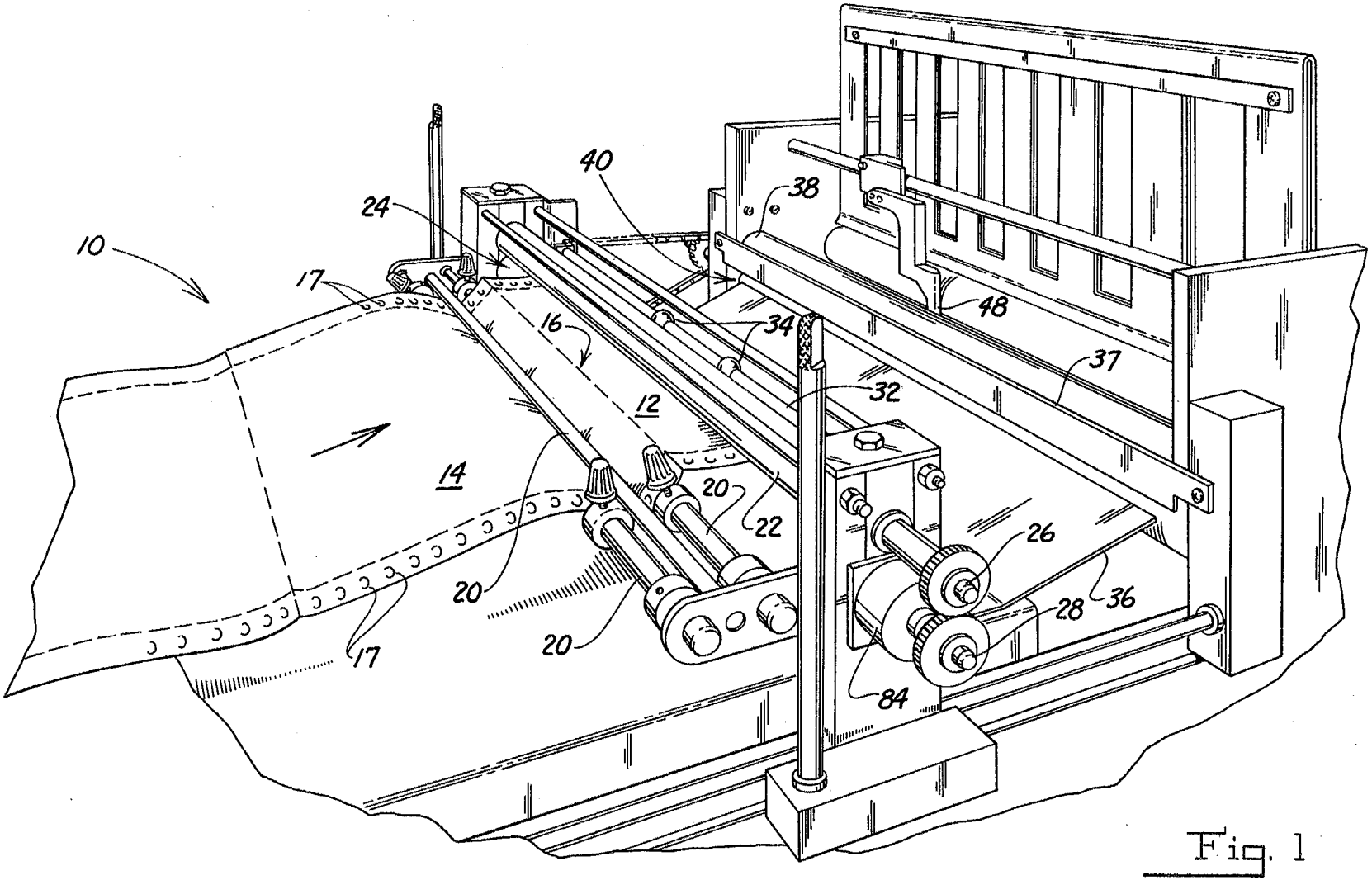
FIG. 1 shows a perspective front view of the bursting apparatus of this invention operating on a continuous web of forms.

Referring now to FIGS. 1 and 2, there is shown a continuous web of forms 10 of a type which are to be processed for ultimate use, such as folding, inserting into envelopes, and mailing. The forms 10 are continuous with the first form in the series, illustrated as form 12 succeeded by the next form 14 which forms are delineated by a perforated line 16 therebetween. The embodiment of the web of forms 10 shown in FIG. 1 shows a plurality of sprocket holes 17 along each side edge of the web. Alternatively no sprocket holes 17 need be present for proper operation of the present invention.

Alternatively, two continuous series of forms 10 can be processed with so-called "two-up" technique by which a first series of forms 10 overlays another series of forms 10. The forms 12 of one series are staggered with respect to the forms 12 of the other series by the distance of one half the length of an individual form 12. The perforation lines 16 of one series of forms 10 are superimposed intermediate the perforation lines 16 of the overlayed series of forms 10. For purposes of the description hereinafter presented, the series of forms 10 is referred to as a single web of material; but it is to be understood that the present invention is also intended to process and separate individual forms from two distinct webs input in staggered relationship with each other. an upper infeed foller 22 and a lower infeed roller 24. The infeed rollers are axially mounted on a upper infeed roller shaft 26 and a lower infeed roller shaft 28 respectively. The emergent forms 10 are then fed under a breaker roller 32 having two spheres 34 axially mounted thereon. Alternatively three or more spheres 34 may be used and can be movable to intermediate positions along the breaker roller 32.

A guide plate 36 is bent upwardly away from the infeed rollers 22 and 24 to direct the emergent forms 10. A retaining bar 37 is suitably mounted by conventional means above the guide plate 36 and extends perpendicular to the path of form travel. A pair of outfeed rollers consisting of an upper outfeed roller 38 and a lower outfeed roller 40, axially mounted respectively on an upper outfeed roller shaft 42 and a lower outfeed roller shaft 44, then grips the emergent forms 10. A light source 46 and a photodetector 48 are suitably mounted by conventional means next to the pair of outfeed rollers 38 and 40.

Referring now to FIGS. 2 and 3, it can be seen that the breaker roller 32 is mounted in the bursting apparatus so that the lower surface of the spheres 34 extends below the normal path of form travel.

Figure 4:
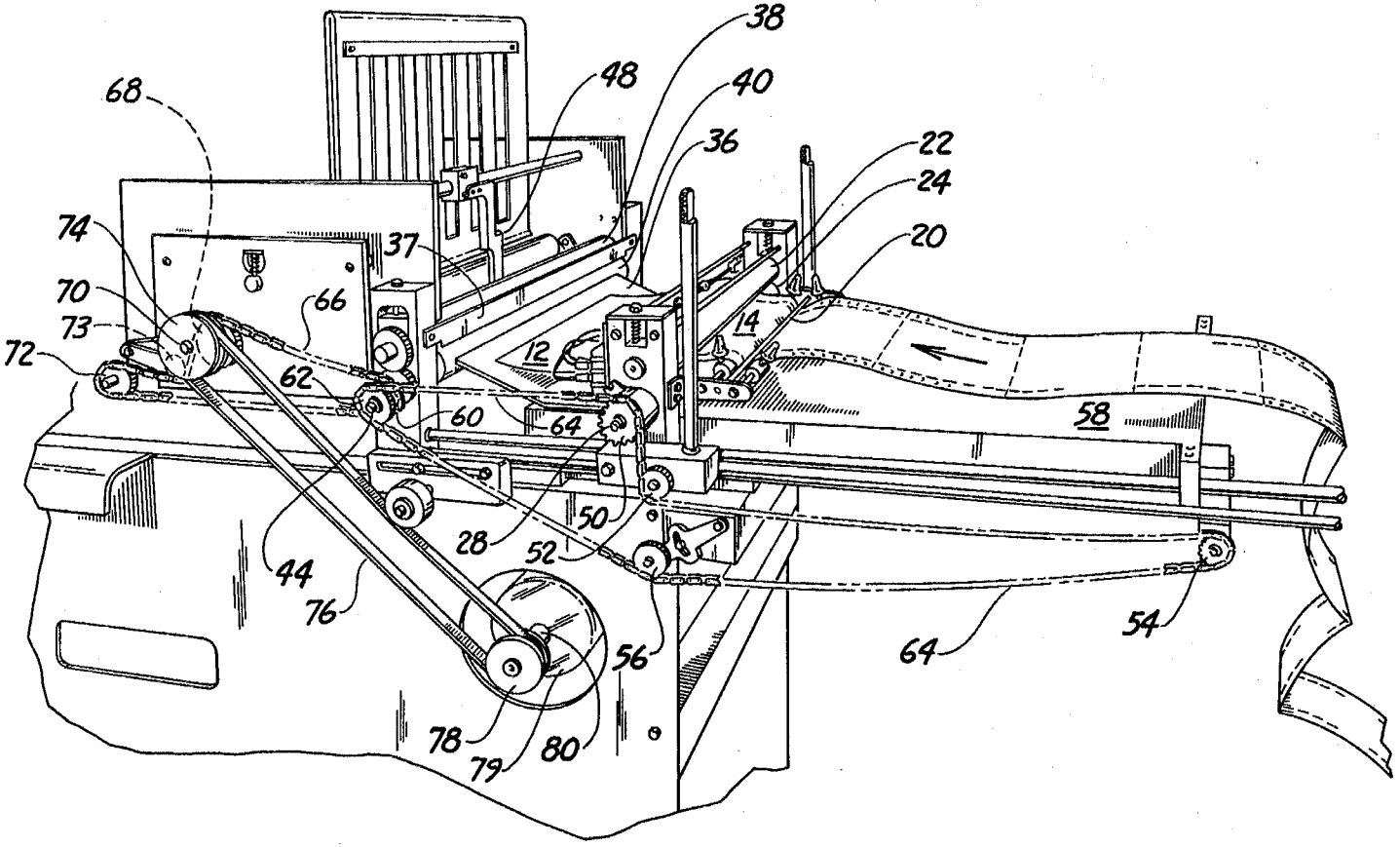
FIG. 4 is an perspective rear view of the bursting apparatus of this invention operating on a continuous web of forms.

Referring now to FIG. 4, a sprocket pulley 50 is attached to the lower infeed roller shaft 28. Guiding sprocket pulleys 52, 54 and 56 respectively attached to the bursting apparatus beneath the lower infeed roller 24, at the outermost point of the deck 58 and below the guiding sprocket pulley 52. The lower outfeed roller 40 also has a shaft 44 to which are attached two sprocket pulleys 60 and 62. A chain belt 64 is trained over sprocket pulleys 62 and 50, under sprocket pulley 52, around sprocket pulley 54, and under sprocket pulley 56.

The innermost sprocket 60 on the lower outfeed roller shaft 44 is connected by means of a chain belt 66 to a drive sprocket pulley 68 mounted on a drive axle 70. The chain belt 66 is also trained around a guiding sprocket pulley 72 and an idler sprocket pulley 73 both located on the bursting apparatus. Also attached to the drive axle 70 at its outermost point is a pulley 74 around which is trained a rubber drive belt 76 extending from a pulley 78 on the drive shaft 80 of a motor, now shown.

Figure 5:
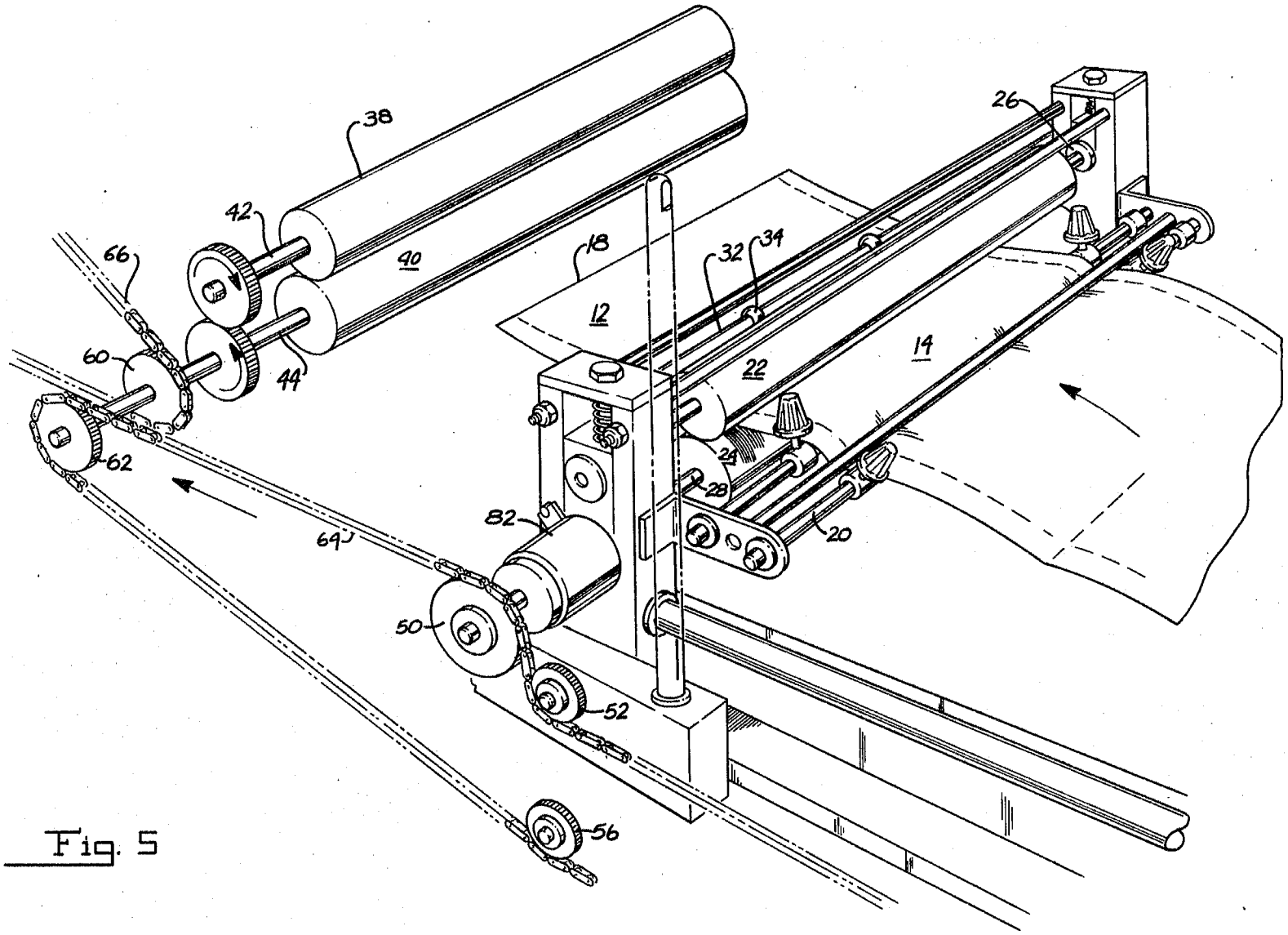
FIG. 5 is an enlarged perspective rear view of the drive means of this invention.

Referring now to FIG. 5 and again to FIG. 1, an electromagnetic clutch 82, such as type SO17, manufactured by Inertia Dynamics, Inc., is mounted on the lower infeed roller shaft 28 between the lower infeed roller 24 and the sprocket pulley 50. An electro magnetic brake 84, such as type PB-170, manufactured by Warner Electric Brake and Clutch Company, is mounted at the end of the lower infeed roller shaft 28 opposite the end on which the clutch 82 is mounted.

Referring now to FIG. 6, an electronic circuit is shown generally by reference numeral 86. A light emitting diode 46 is connected to a source of power 88. A photodetector 48 has its emitter grounded and its collector tied through a resistor 90 to a source of positive potential power supply, designated $V_{PC}$, sufficient to drive the photodetector 48. The collector of this photodetector 48 also provides the input to a buffer 92. The output of the buffer 92 provides the input to the base of a power driving transistor 94 and to an inverter 98 whose output is tied to the base of another power driving transistor 96. Both of the transistors 94 and 96 are darlington pairs, for example.

One of the driving transistors 94 has its collector tied to one side of the electro mechanical brake 84, and the other side of which brake 84 is connected to a source of positive potential power supply $V_B$ sufficient to drive the brake 84. The collector of the other driving transistor 96 is tied to one side of the electro mechanical clutch 82, the other side of which clutch 82 is connected to a source of positive potential power supply, designated $V_C$ sufficient to drive the cluth 82.

The emitters of both driving transistors 94 and 96 are grounded. The collectors of both driving transistors 94 and 96, in addition to being tied respectively to one side of the brake 84 and to one side of the clutch 82, are also tied to respective zener diodes 100 and 120, which zener diodes are both grounded. These zener diodes 100 and 102 perform a surge voltage overload protection function for both driving transistors 94 and 96.

In operation when the motor 79 (FIG. 4) is actuated, the motor shaft 80 rotates, turning the motor pulley 78 and driving the rubber belt 76. The belt 76 turns the pulley 74 attached to the drive axle 70, thereby rotating the drive axle 70. The drive sprocket pulley 68, which is mounted on the rotating drive axle 70, is also forced to rotate, driving the chain belt 66 around sprocket pulleys 72, 73 and 60. Sprocket pulley 60 turns the lower outfeed roller shaft 44, thereby also rotating the lower outfeed roller 40 as well as the sprocket pulley 62. The sprocket pulley 62 drives the chain belt 64 around sprocket pulleys 50, 52, 54 and 56. Rotation of the sprocket pulley 50 causes the lower infeed roller shaft 28 to turn, thus rotating the lower roller 24 affixed thereto.

The continuous series of forms 10 travels over, under and over the alignment shafts 20 respectively and is fed between the upper infeed roller 22 and the lower infeed roller 24. The series of forms 10 then travels under the spheres 34 which are axially mounted on the breaker roller 32. Alternatively the series of forms 10 may be directed over the breaker roller spheres 34 if an even greater longitudinal tension along the transverse perforation line 16 separating the forms 12 and 14 is desired. The forms 10 are directed upwardly by the guide plate 36 and pass below the retaining bar 37.

The series of forms 10 is then gripped between the upper outfeed roller 38 and the lower outfeed roller 40. The leading edge 18 of the first form 12 then interrupts a light beam generated by the light source 46 and extending therefrom to the photodetector 48.

When the light generated by the light source 46 is interrupted by the leading edge 18 of the form 12, the base of the photodetector 48 no longer receives the light. The collector of the photodetector 48 is at a high potential and therefore the output from the buffer 92 is also high. The buffer output is the input of the driving transistor 94, so the high signal turns the transistor 94 on. This conductive state of the transistor 94 allows the brake 84 to be energized. The brake 84 is thus actuated to halt rotation of the lower infeed roller 24. The high output from the buffer 92 is simultaneously fed to the inverter 98, which inverts the signal to a low potential. This low signal is input to the driving transistor 96, turning the transistor 96 off, thereby de-energizing the clutch 82. Consequently, the clutch 82 disengages the lower infeed roller shaft 28 from the driving sprocket pulley 50.

Rotation of the lower outfeed roller 40 is unaffected by the braking of the lower infeed roller 24. The outfeed rollers continue to grip and pull the series of forms 10 with the same force used before rotation of the lower infeed roller 24 was halted. Consequently increased longitudinal tension is generated along the forms 12 and 14, promoting rupture at the perforation line 16.

The distance between the pairs of infeed rollers 22 and 24 and outfeed rollers 38 and 40 relative to the length of a form 12 is adjustable by conventional means to ensure that at the moment of infeed roller braking the perforation line 16 is centered below the breaker roller spheres 34. The distance between pairs of rollers can be decreased for burster use with shorter forms 12 by moving the pair of infeed rollers 22 and 24 closer to the pair of outfeed rollers 38 and 40. Similarly longer forms 12 can be accommodated by moving the infeed rollers 22 and 24 away from the outfeed rollers 38 and 40. For most efficient operation the distance between centers of the lower infeed roller 24 and the lower outfeed roller 40 should be substantially equal to the length of a typical form 12.

After the first form 12 has been separated from the next form 14, it passes the light source 46 and photodetector 48. The beam of light generated by the light source 46 is no longer interrupted, allowing the base of the photodetector 48 to receive the light beam. The collector of the photodetector 48 is at a low potential and therefore the output from the buffer 92 is also low. The buffer output is the input for the driving transistor 94, so the low signal turns the transistor 94 off. This nonconductive state of the transistor 94 prevents actuation of the brake 84. The brake 84 is de-energized.

The low output from the buffer 92 is simultaneously fed to the inverter 98, which inverts the signal to a high potential. This high signal is input to the driving transistor 96, turning the transistor 96 on. The electro mechanical clutch 82 to which this transistor 96 is tied, is again engaged to drive the lower infeed roller shaft 28 by its associated driving sprocket pulley 50. The pair of infeed rollers 22 and 24 thus feeds the next form 14 between the pair of outfeed rollers 38 and 40. The leading edge of this form 14, which had been a perforation line 16, is directed through the outfeed rollers 38 and 40 and thereafter interrupts the light beam between the light source 46 and the photodetector 48 thus again initiating the braking cycle as hereinbefore described.

It has been found that the present invention can be used in a process to separate twice the number of forms 10 in the same amount of time as is required for single form feeding and bursting operations as hereinbefore described. Briefly, the aforementioned process known as "two-up" processing consists of staggering two supplies of forms, such that one series of forms 10 overlays another. Both series of forms 10 travel along the same path, as previously described. The lower series of forms 10 is offset from the upper series of forms 10 by half the length of an individual form 12. Consequently the perforation lines 16 of one series of forms 10 are superimposed intermediate the perforation lines 16 of the overlayed series of forms 10. The effect of providing this staggered form input is to double the output of the bursting apparatus over a given length of time. The bursting cycle doubles in frequency, concomitantly actuating the photodetector 48, the electro mechanical brake 84 and the clutch 82 twice as often as they would be actuated during operation with a single series of forms 10.

The burster apparatus of the present invention can be attached directly to conventional downstream folding, inserting, mailing and/or other document processing machines. When so used the forms may thus be completely machine processed in a continuous line operation from computer printout to mailing. When performing the bursting operation using applicant's invention the usual bulky and expensive machines for performing this function are eliminated, thus form processing is accelerated and costly manual labor operations are practically eliminated.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of the invention.

We claim:

1. A bursting apparatus for conveying a web of material, on which are disposed successive transverse lines of weakening, along a longitudinal path from an upstream position to a downstream position, and for separating said web along a transverse line of weakening, comprising:

(a) a longitudinally extending housing;

(b) a first pair of vertically spaced rollers rotatably supported by said housing transverse to said path of web travel;

(c) a second pair of vertically spaced rollers rotatably supported by said housing downstream said first pair of rollers;

(d) a breaker roller mounted on said housing transverse to said path of web travel intermediate said first and second pairs of rollers for causing longitudinal tension along said web of material thereby creating a tendency of rupture along said transverse line of weakening;

(e) means for driving said first and second pairs of rollers;

(f) a magnetic brake supported by said housing operatively connected to said first pair of rollers for halting the rotation thereof; and (g) a magnetic clutch selectively disengaging said drive means from said first pair of rollers whereby when said web of material is simultaneously gripped by both of said pair of rollers, severence of said web of material is promoted along said transverse line of weakening when said transverse line of weakening is disposed intermediate said first and second pair of rollers and said magnetic brake is energized to halt the rotation of said first pair of rollers.

2. The bursting apparatus of claim 1, wherein said first pair of rollers and said breaker roller are movable relative to said second pair of rollers for compensating for different lengths of said web of meterial between said successive transverse lines of weakening.

3. The bursting apparatus of claim 1, wherein said drive means drives said second pair of rollers at substantially uniform speed.

4. The bursting apparatus of claim 1, wherein said breaker roller is disposed above said longitudinal path, whereby said longitudinal path is under said breaker roller.

5. The bursting apparatus of claim 1, wherein said breaker roller includes a shaft transverse to said longitudinal path and at least one sphere axially mounted on said shaft for promoting a discrete point of increased tension along said transverse line of weakening.

6. The bursting apparatus of claim 5, wherein said sphere is movable along intermediate positions of said breaker roller shaft.

7. The bursting apparatus of claim 1, wherein said breaker roller is disposed below said longitudinal path, whereby said longitudinal path is over said breaker roller.

8. A bursting apparatus for conveying a web of material, on which are disposed successive transverse line of weakening, along a longitudinal path from an upstream position to a downstream position, and for separating said web along a transverse line of weakening, comprising;

(a) a longitudinally extending housing;
(b) a first means for feeding said web supported by said housing;
(c) a second means for feeding said web supported by said housing downstream said first feeding means;
(d) a tension producing means intermediate said first and second feeding means for causing longitudinal tension along said web of material thereby creating a tendency to rupture along said transverse line of weakening;
(e) means for driving said first and second feeding means;
(f) a braking means supported by said housing operatively connected to said first feeding means for halting the operation thereof; and
(g) a clutch selectively disengaging said drive means from said first feeding means whereby when said web of material is simultaneously gripped by both of said feeding means, severance of said web of material is promoted along said transverse line of weakening when said transverse line of weakening is disposed intermediate said first and second feeding means and said braking means is actuated to halt the operation of said first feeding means.

9. The bursting apparatus of claim 8, wherein said drive means drives said second feeding means at substantially uniform speed.

10. The bursting apparatus of claim 8, further comprising timing means operatively connected to said braking means for actuating said braking means to halt the operation of said first feeding means, whereby the feeding of said web of material is halted when said tension producing means is substantially adjacent said transverse line of weakening.

11. A bursting apparatus for conveying two webs of overlaying material, on which are disposed successive transverse lines of weakening, the first of said webs of material being offset with respect to the second of said webs of material along a longitudinal path from an upstream position to a downstream position, and for separating said webs along respective transverse lines of weakening, comprising:

(a) a longitudinally extending housing;
(b) a first means for feeding said webs supported by said housing transverse to said path of web travel;
(c) a second means for feeding said webs supported by said housing downstream said first feeding means;
(d) a tension producing means mounted on said housing transverse to said path of web travel intermediate said first and second feeding means for causing longitudinal tension along said webs of material thereby creating a tendency to rupture along said transverse lines of weakening;
(e) means for driving said first and second feeding means;
(f) a braking means supported by said housing operatively connected to said first feeding means for halting the operation thereof; and
(g) a clutch selectively disengaging said drive means from said first feeding means whereby when said webs of material are simultaneously gripped by both of said feeding means, severance of said webs of material is promoted along said transverse lines of weakening when said transverse lines of weakening are disposed intermediate said first and said second feeding means and said braking means is actuated to halt the operation of said first feeding means.

12. The bursting apparatus of claim 11, wherein said first feeding means and said tension producing means are movable relative to said second feeding means for compensating for different lengths of said webs of material between said successive transverse lines of weakening.

13. The bursting apparatus of claim 11, wherein said drive means drives said second feeding means at substantially uniform speed.

14. A bursting apparatus for conveying two webs of overlaying material, on which are disposed successive transverse lines of weakening, the first of said webs of material being offset with respect to the second of said webs of material, along a longitudinal path from an upstream position to a downstream position, and for separating said webs along respective transverse liens of weakening, comprising:

(a) a longitudinally extending housing;
(b) a first pair of vertically spaced rollers rotatably supported by said housing transverse to said path of web travel;
(c) a second pair of vertically spaced rollers rotatably supported by said housing downstream said first pair of rollers;
(d) a breaker roller mounted on said housing transverse to said path of web travel intermediate said first and second pair of rollers for causing longitudinal tension along said webs of material thereby creating a tendency to rupture along said transverse lines of weakening;
(e) means for driving said first and second pairs of rollers;
(f) a magnetic brake supported by said housing operatively connected to said first pair of rollers for halting the rotation thereof; and
(g) a magnetic clutch selectively disengaging said drive means from said first pair of rollers whereby when said webs of material are simultaneously gripped by both of said pairs of rollers, severence of said webs of material is promoted along said transverse lines of weakening when said transverse lines of weakening are disposed intermediate said first and said second pair of rollers and said magnetic brake is energized to halt the rotation of said first pair of rollers.

15. The bursting apparatus of claim 14, wherein said first pair of rollers and said breaker roller are movable relative to said second pair of rollers for compensating for different lengths of said webs of material between said successive transverse lines of weakening.

16. The bursting apparatus of claim 14, wherein said drive means drives said second pair or rollers at substantially uniform speed.

17. The bursting apparatus of claim 14, wherein said breaker roller is disposed above said longitudinal path, whereby said longitudinal path is under said breaker roller.

18. The bursting apparatus of claim 14, wherein said breaker roller includes a shaft transverse to said longitudinal path and at least one sphere axially mounted on said shaft for promoting a discrete point of increased tension along said transverse lines of weakening.

19. The bursting apparatus of claim 18, wherein said sphere is movable along intermediate positions of said breaker roller shaft.

20. The bursting apparatus of claim 14, wherein said breaker roller is disposed below said longitudinal path, whereby said longitudinal path is over said breaker roller.

21. A bursting apparatus for conveying two webs of overlaying material, the first of said webs of material being offset with respect to the second of said webs of material, along a longitudinal path from an upstream position to a downstream position, and for separating said webs along respective transverse lines of weakening, comprising:

(a) a longitudinally extending housing;

(b) a first pair of vertically spaced rollers rotatably supported by said housing transverse to said path of web travel;

(c) a second pair of vertically spaced rollers rotatably supported by said housing downstream said first pair of rollers;

(d) a breaker roller mounted on said housing transverse to said path of web travel intermediate said first and second pairs of rollers for causing longitudinal tension along said webs of material thereby creating a tendency to rupture along said transverse lines of weakening;

(e) means for driving said first and second pairs of rollers;

(f) a magnetic brake supported by said housing operatively connected to said first pair of rollers for halting the rotation thereof;

(g) a magnetic clutch selectively disengaging said drive means from said first pair of rollers whereby when said webs of material are simultaneously gripped by both of said pairs of rollers, severence of said webs of material is promoted along said transverse lines of weakening when said transverse lines of weakening are disposed intermediate said first and said second pair of rollers; and (h) timing means operatively connected to said magnetic brake for energizing said magnetic brake to halt the rotation of said first pair of rollers, whereby the feeding of said webs of material is halted when said breaker roller is substantially adjacent each of said transverse lines of weakening.

22. The bursting apparatus of claim 21, wherein said timing means includes a photodetector downstream said first pair of rollers for detecting presence of the leading edge of one of said webs of material.

23. A bursting apparatus for conveying a web of material along a longitudinal path from an upstream position to a downstream position, and for separating said web along a transverse line of weakening, comprising:

(a) a longitudinally extending housing;

(b) a first pair of vertically spaced rollers rotatably supported by said housing transverse to said path of web travel;

(c) a second pair of vertically spaced rollers rotatably supported by said housing downstream said first pair of rollers;

(d) a breaker roller mounted on said housing transverse to said path of web travel intermediate said first and second pairs of rollers for causing longitudinal tension along said web of material thereby creating a tendency to rupture along said transverse line of weakening;

(e) means for driving said first and second pairs of rollers;

(f) a magnetic break supported by said housing operatively connected to said first pair of rollers for halting the rotation thereof;

(g) a magnetic clutch selectively disengaging said drive means from said first pair of rollers whereby when said web of material is simultaneously gripped by both of said pairs of rollers, severence of said web of material is promoted along said transverse line of weakening when said transverse line of weakening is disposed intermediate said first and said second pair of rollers; and (h) timing means opertatively connected to said magnetic brake for energizing said magnetic brake to halt the rotation of said first pair of rollers, whereby the feeding of said web of material is halted when said breaker roller is substantially adjacent said transverse line of weakening.

24. The bursting apparatus of claim 23, wherein said timing means includes a photodetector downstream said first pair of rollers for detecting presence of the leading edge of said web of material.

* * * * *

UNITED STATES PATENT AND TRADEMARK OFFICE

CERTIFICATE OF CORRECTION

PATENT NO. : 4,261,497

DATED : April 14, 1981

INVENTOR(S) : Francis T. Roetter and Frank A. Oeschger

It is certified that error appears in the above—identified patent and that said Letters Patent is hereby corrected as shown below:

Column 3, line 43, after "56" there should be the word --are--.

Column 6, line 59, "pair" is --pairs--.

Column 7, line 1, "meterial" should be --material--.

Column 7, line 23, "line" should be --lines--.

Column 8, line 45, "liens" should be --lines--.

Signed and Sealed this

*Twentieth* Day of *September 1983*

[SEAL]

*Attest:*

GERALD J. MOSSINGHOFF

*Attesting Officer*

*Commissioner of Patents and Trademarks*